US011656049B2

(12) United States Patent
Young et al.

(10) Patent No.: US 11,656,049 B2
(45) Date of Patent: May 23, 2023

(54) MULTI-CORE FIREARM SUPPRESSOR

(71) Applicant: Primary Weapons Systems, Inc., Boise, ID (US)

(72) Inventors: Nolan Blake Young, Boise, ID (US); Dean Sylvester, Boise, ID (US)

(73) Assignee: PRIMARY WEAPONS SYSTEMS INC., Boise, ID (US)

( * ) Notice: Subject to any disclaimer, the term of this patent is extended or adjusted under 35 U.S.C. 154(b) by 8 days.

(21) Appl. No.: 17/336,028

(22) Filed: Jun. 1, 2021

(65) Prior Publication Data

US 2021/0381792 A1 Dec. 9, 2021

Related U.S. Application Data

(60) Provisional application No. 63/034,542, filed on Jun. 4, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36; F41A 21/38
USPC ..... 89/14.3–14.5
See application file for complete search history.

(56) References Cited

U.S. PATENT DOCUMENTS

| | | | | |
|---|---|---|---|---|
| 8,881,862 | B1 * | 11/2014 | Messer, Jr. | F41A 21/30 89/14.4 |
| 9,593,899 | B2 * | 3/2017 | Coppinger | F41A 21/30 |
| 10,317,161 | B2 * | 6/2019 | Arnedo Vera | F41A 21/02 |
| 10,345,070 | B1 * | 7/2019 | Lepka | F41A 21/30 |
| 2016/0209151 | A1 * | 7/2016 | Smith | F41A 21/30 |
| 2018/0202742 | A1 * | 7/2018 | Brittingham | F41A 21/34 |
| 2018/0306544 | A1 * | 10/2018 | White | F41A 21/30 |
| 2019/0339036 | A1 * | 11/2019 | Edminster | F41A 21/30 |
| 2020/0284541 | A1 * | 9/2020 | Poling | F41A 21/30 |
| 2020/0309478 | A1 * | 10/2020 | Meaux | F41A 21/30 |
| 2021/0003360 | A1 * | 1/2021 | Kras | F41A 21/30 |
| 2021/0333061 | A1 * | 10/2021 | Muceus | B22F 5/106 |
| 2021/0341246 | A1 * | 11/2021 | Kunsky | F41A 21/30 |

* cited by examiner

*Primary Examiner* — Jonathan C Weber
(74) *Attorney, Agent, or Firm* — Parsons Behle & Latimer

(57) ABSTRACT

A multi-core suppressor for a firearm. The multi-core suppressor includes a housing having a first and second ends and a central main core positioned within the housing. The central main core has a first end, a second end, and a longitudinal centerline with a plurality of central baffle portions positioned adjacent to the longitudinal centerline and a projectile path through the central baffle portions. The multi-core suppressor includes a first side core positioned between the housing and a first side of the central main core and a second side core positioned between the housing and a second side of the central main core. The first side core has a plurality of first side baffle portions and the second side core has a plurality of second side baffle portions. The first and side baffle portions engage the central baffle portions to form a plurality of baffles positioned within the housing.

18 Claims, 17 Drawing Sheets

MULTI-CORE FIREARM SUPPRESSOR

RELATED APPLICATION

This application claims the benefit of priority under 35 U.S.C. § 119 to U.S. Provisional Patent Application Ser. No. 63/034,542 entitled "MULTI-CORE FIREARM SUPPRESSOR" filed on Jun. 4, 2020, which is incorporated herein in its entirety.

FIELD OF THE DISCLOSURE

The embodiments described herein relate to a firearm suppressor having a multi-core.

BACKGROUND

Description of the Related Art

A suppressor may be used to reduce the noise made during the discharge of a firearm. One example of a prior firearm suppressor is a housing that includes a series of baffles positioned within the housing. For example, the housing, also referred to as a can, may include a series of k-type baffles positioned within the can. The baffles are constructed to provide a series of chambers that permit the contraction and expansion of the gas created by the discharge of ammunition. Baffles include a central opening permitting a fired projectile to pass through the suppressor. The central portion of the baffles takes the brunt of the force of the gasses generated during the discharge of the firearm. Repeated use of the suppressor can damage the central portion of the baffles causing the suppressor to be ineffective or, if permitted, replacement one or more baffles of the suppressor. Accordingly, there is a need to provide firearm suppressor that may permit the replacement of only damaged portions of the baffles. Other drawbacks and disadvantages of present suppressor systems also exist.

SUMMARY

The present disclosure is directed to a firearm suppressor with a multi-core that addresses some of the problems and disadvantages discussed above.

One embodiment is a multi-core suppressor for a firearm. The multi-core suppressor comprises a housing having a first end and a second end. The multi-core suppressor includes a central main core positioned within the housing, the central main core having a first end, a second end, and a longitudinal centerline, the central main core having a plurality of central baffle portions positioned adjacent to the longitudinal centerline with a projectile path through the central baffle portions along the longitudinal centerline. The multi-core suppressor includes a first side core positioned within the housing, the first side core being positioned between the housing and a first side of the central main core, the first side core having a plurality of first side baffle portions. The multi-core suppressor includes a second side core positioned within the housing, the second side core being positioned between the housing and a second side of the central main core, the second side core having a plurality of second side baffle portions. The first side baffle portions engage the central baffle portions and the second side baffle portions engage the central baffle portions to form a plurality of baffles positioned within the housing.

The first side baffle portions may also engage the second side baffle portions to further form the plurality of baffles positioned within the housing. The first side core and the second side core may interlock with the central main core to form an enclosed entrance chamber. The central main core may include first internal threads at the first end. The internal threads may be configured to connect the central main core to a barrel of a firearm. The second end of the central main core may include second internal threads.

The multi-core suppressor may include a modular baffle connected to the second end of the central main core via the second internal threads. The multi-core suppressor may include comprising a plurality of modular baffles connected to the second end of the central main core. The multi-core suppressor may include an end cap connected to a modular baffle of the plurality of modular baffles.

The multi-core suppressor may include an adapter connected to the first end of the central main core with the adapter being configured to connect to a barrel of a firearm. The central main core may include a port at the first end configured to connect to a gas block of a firearm. The multi-core suppressor may include an end cap connected to the second end of the of the central main core. The end cap may be threaded into the second threads of the central main core. The housing of the multi-core suppressor may include one or more exterior grooves that extend from the first end to the second end.

One embodiment is a multi-core suppressor for a firearm. The multi-core suppressor comprises a housing having a first end and a second end. The multi-core suppressor includes a central main core positioned within the housing, the central main core having a first end, a second end, and a longitudinal centerline, the central main core having a plurality of central baffle portions positioned adjacent to the longitudinal centerline with a projectile path through the central baffle portions along the longitudinal centerline. The multi-core suppressor includes a first side core positioned within the housing, the first side core being positioned between the housing and a first side of the central main core, the first side core having a plurality of first side baffle portions. The multi-core suppressor includes a second side core positioned within the housing, the second side core being positioned between the housing and a second side of the central main core, the second side core having a plurality of second side baffle portions. The first side baffle portions engages the central baffle portions and the second side baffle portions and the second side baffle portions engages the central baffle portions and the first side baffle portions to form a plurality of baffles positioned within the housing.

Figure 1:
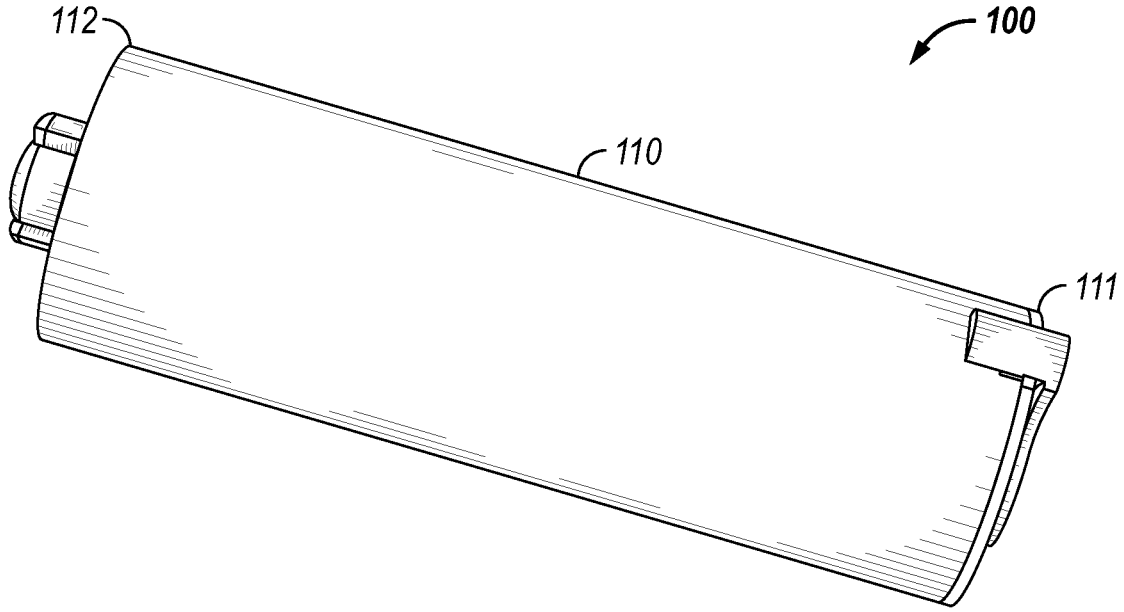
FIG. 1 shows a perspective view of an embodiment of a firearm suppressor having a multi-core.
Figure 2:
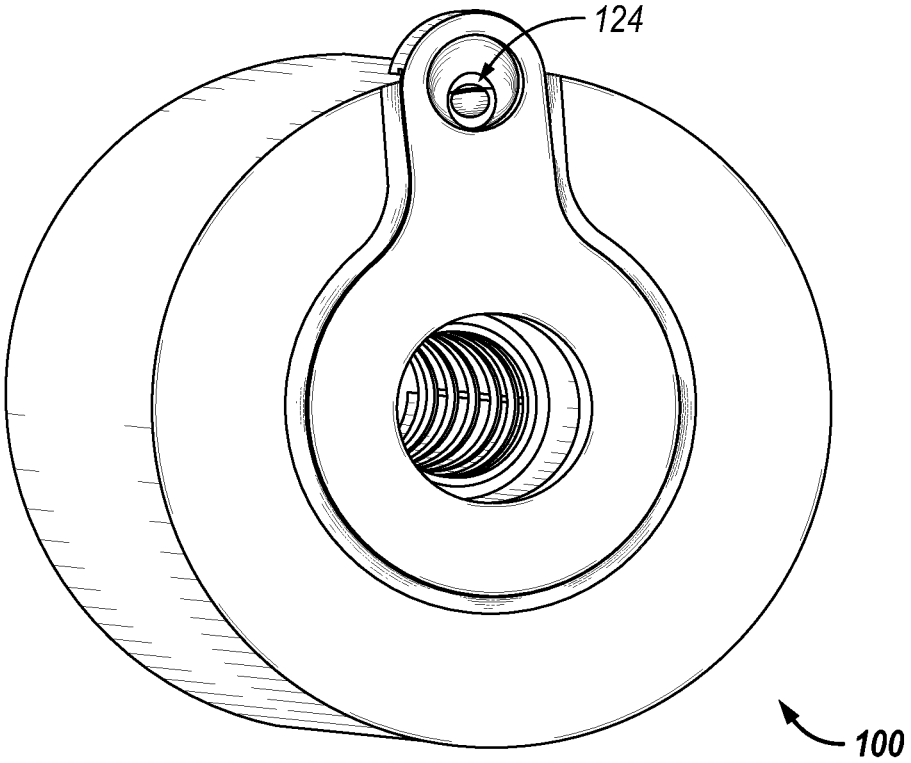
FIG. 2 shows a perspective end view of the firearm suppressor of FIG. 1.
Figure 3:
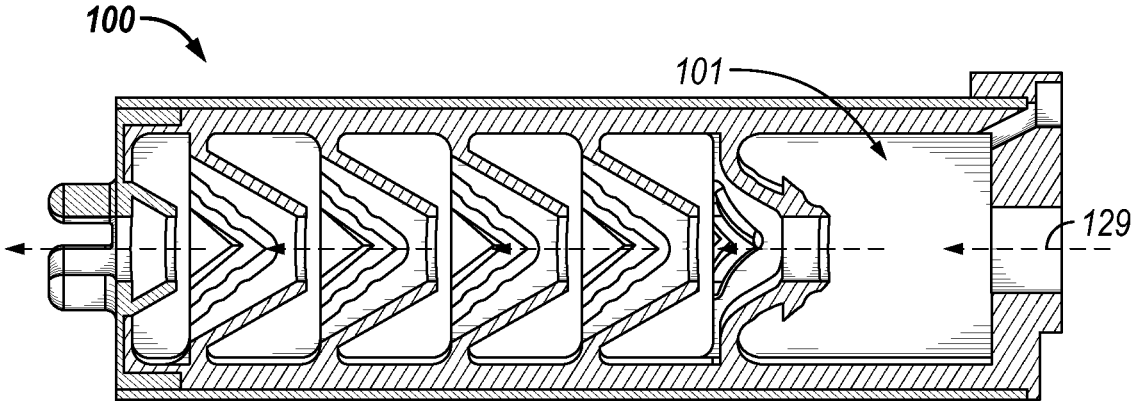
FIG. 3 shows a cross-section side view of the firearm suppressor of FIG. 1.
Figure 4:
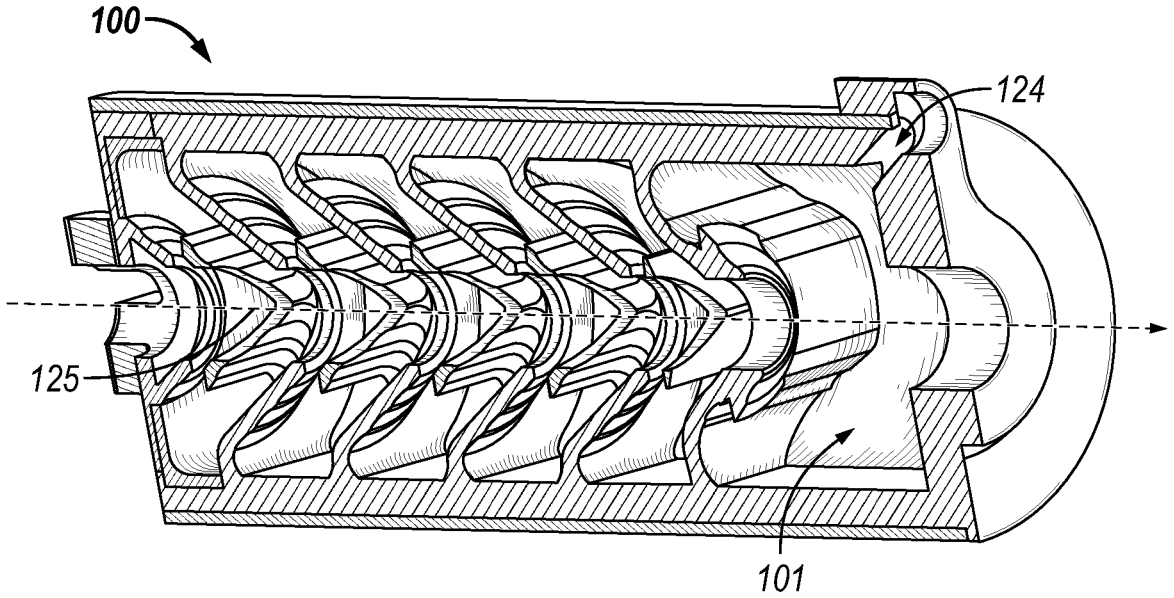
FIG. 4 shows a perspective cross-section view of the firearm suppressor of FIG. 1.
Figure 5:
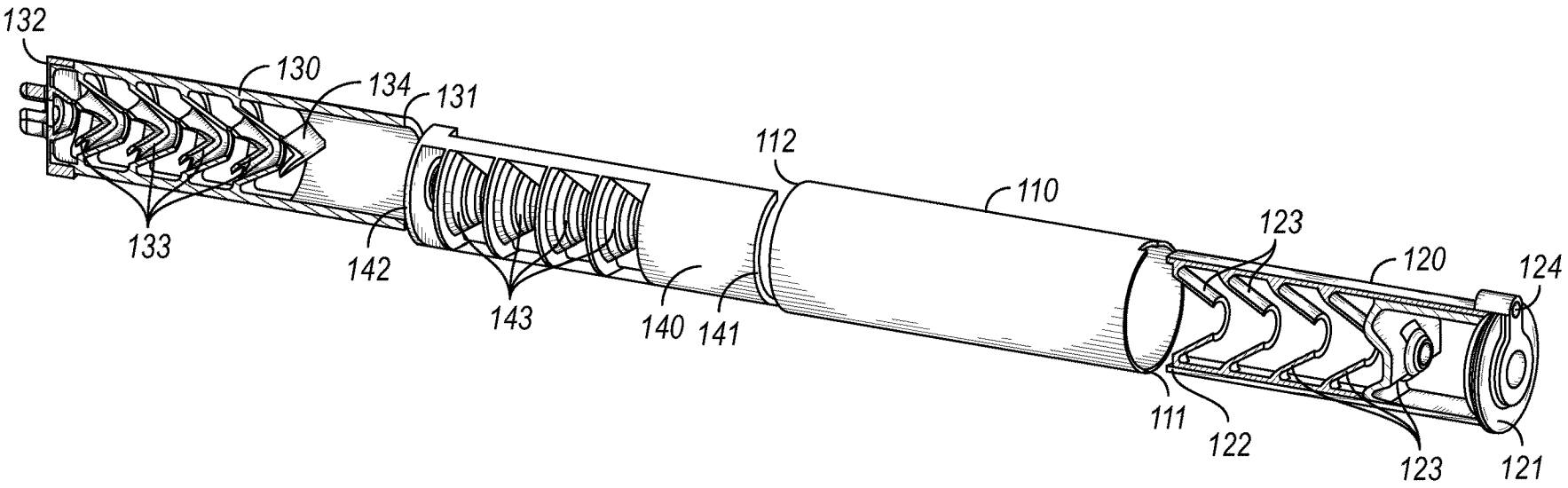
FIG. 5 shows an exploded view of the firearm suppressor of FIG. 1.
Figure 6:
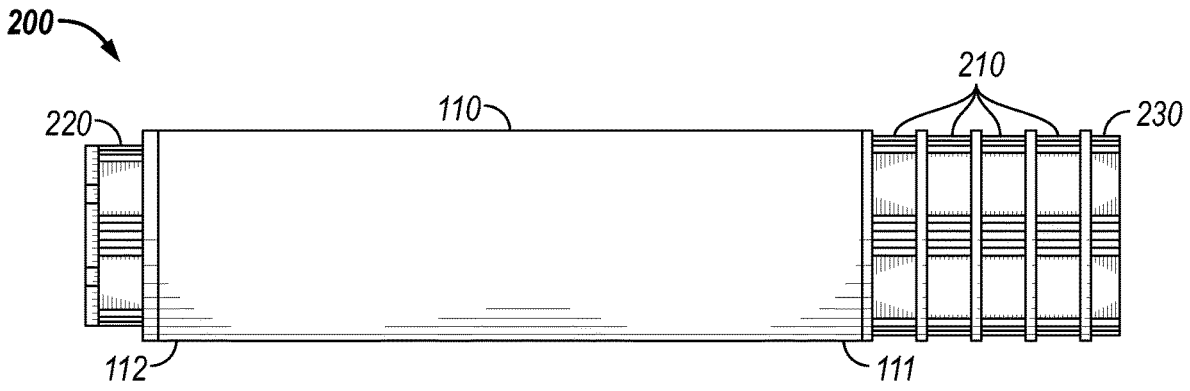
FIG. 6 shows an embodiment of a firearm suppressor having a multi-core.
Figure 7:
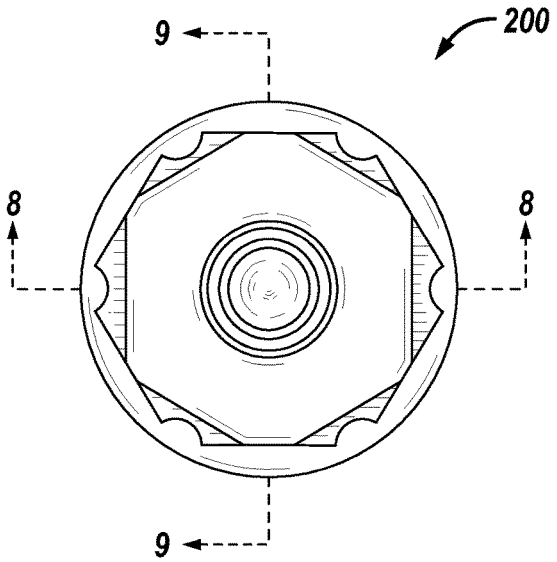
FIG. 7 shows an end view of the firearm suppressor of FIG. 6.
Figure 8:
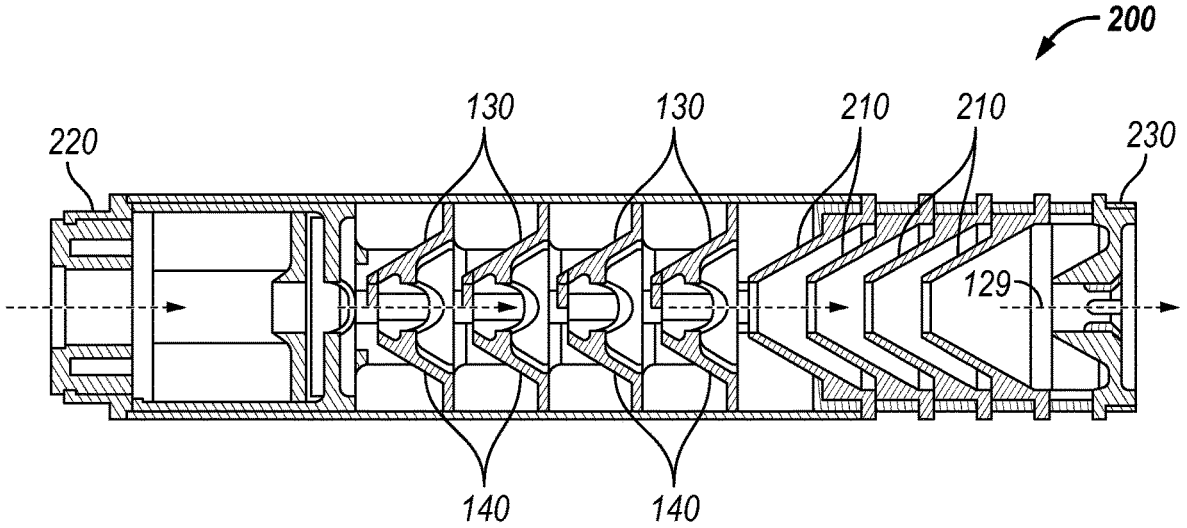
FIG. 8 shows a cross-section view along line 8 of the firearm suppressor of FIG. 6.
Figure 9:
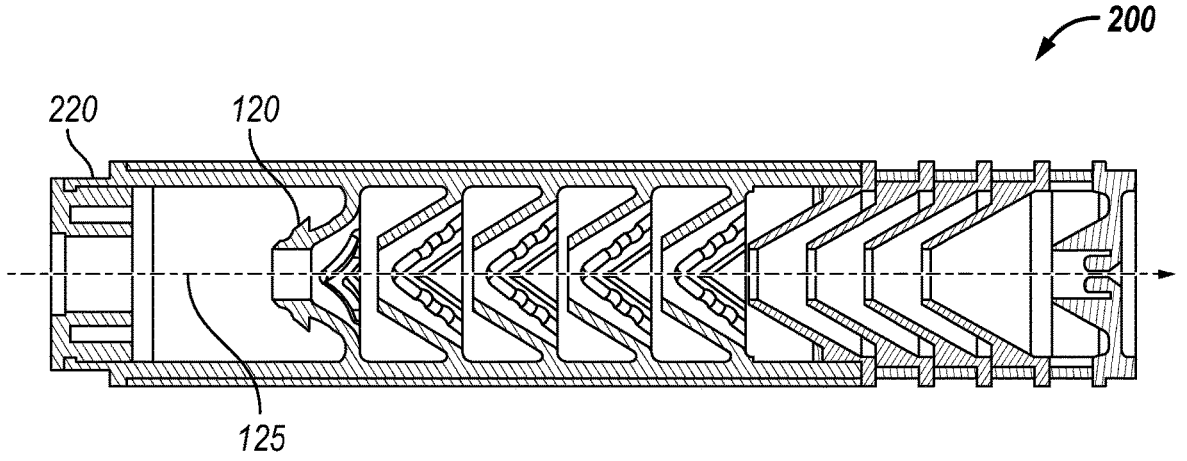
FIG. 9 shows a cross-section view along line 9 of the firearm suppressor of FIG. 6.
Figure 10:
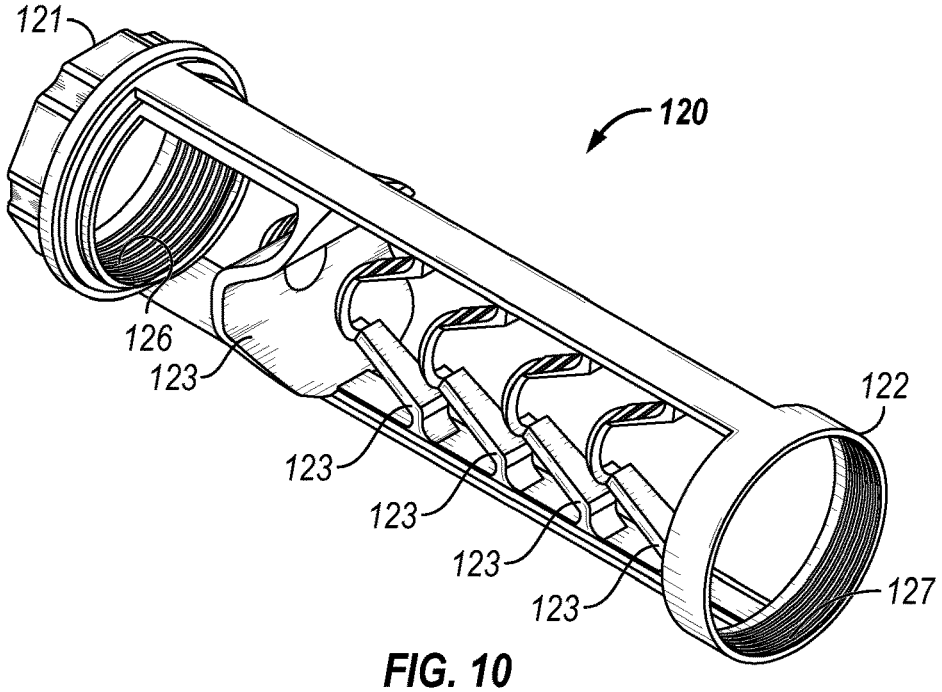
FIG. 10 shows a perspective view of an embodiment of a central main core that may be used in a multi-core firearm suppressor.
Figure 11:
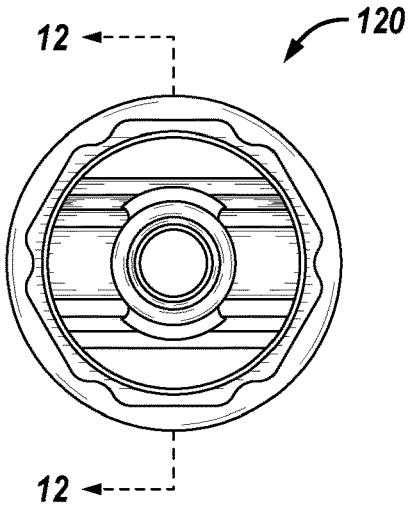
FIG. 11 shows an end view of the central main core of FIG. 10.
Figure 12:
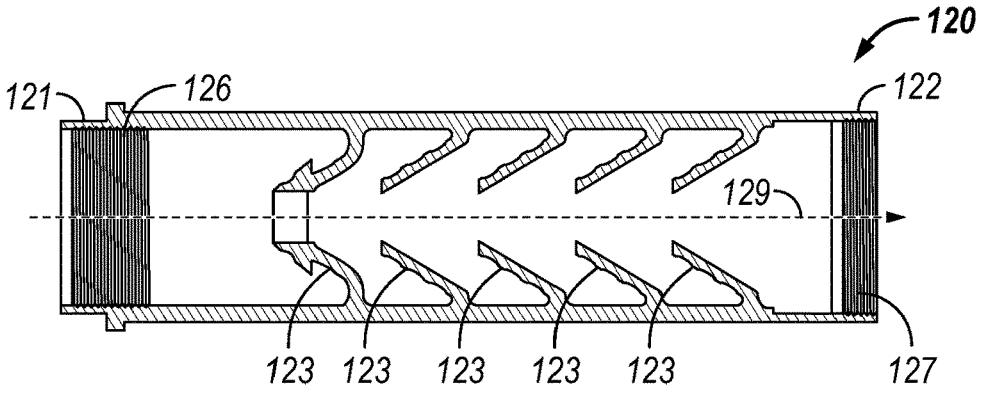
FIG. 12 shows a cross-section view along line 12 of the central main core of FIG. 10.
Figure 13:
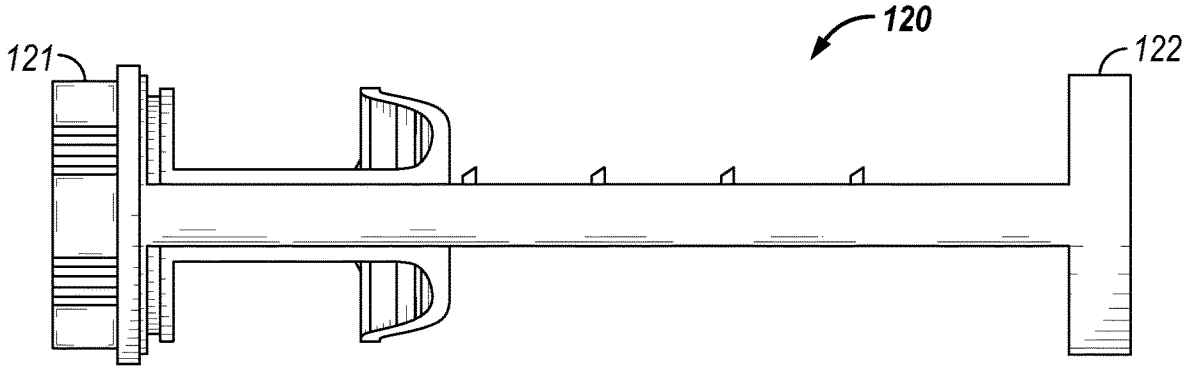
FIG. 13 shows a side view of the central main core of FIG. 10.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIGS. 1-5 show an embodiment of a multi-core firearm suppressor 100. The suppressor includes a housing 110 having a first end 111 and a second end 112. A central main core 120 is positioned within the housing 110. The central main core 120 includes a first end 121, a second end 122, and has a longitudinal centerline 125. The central main core 120 includes a plurality of central baffle portions 123 that are positioned adjacent to the longitudinal centerline 125. The central baffle portions 123 engage or interlock with baffle portions from a first side core 130 and a second side core 140 to form baffles within the housing 110 as discussed herein. The central baffle portions 123 include a projectile path 129 along the longitudinal centerline 125 to enable a projectile to pass through multi-core firearm suppressor 100.

The multi-core firearm suppressor 100 includes a first side core 130 that is positioned within the housing 110. The first side core 130 includes a first end 131 and a second end 132. The first side core 130 is positioned between the housing 110 and a first side of the central main core 120. The first side core 130 includes a plurality of first side baffle portions 133. The first side core 130 also includes a portion 134 that engages the central main core 120 to help strengthen an enclosed entrance chamber 101 of the multi-core firearm suppressor 100.

The multi-core firearm suppressor 100 includes a second side core 140 that is positioned within the housing 110. The second side core 140 includes a first end 141 and a second end 142. The second side core 140 is positioned between the housing 110 and a second side of the central main core 120. The second side core 140 includes a plurality of second side baffle portions 143. The second side core 140 also includes a portion that engages the central main core 120 to help strengthen an enclosed entrance chamber 101 of the multi-core firearm suppressor 100.

When the central main core 120, first side core 130, and second side core 140 are positioned within the housing 110, the first side baffle portions 133 and the second side baffle portions 143 each engage the central baffle portions 123 to form baffles within the housing 110 that include a projectile path 129 along the longitudinal centerline 125. The combined baffles may be used to suppress the sound of the discharge of a firearm connected to the multi-core firearm suppressor 100. The combined baffles cause the expansion and contraction of the gas from the discharge of the firearm that reduces the sound of the discharge as would be appreciated by one of ordinary skill in the art having the benefit of this disclosure.

During the discharge of the firearm connected to the multi-core firearm suppressor 100, the central baffle portions 123 of the combined baffles typically take the brunt of the force from the high-pressure gasses from the discharge. Thus, the central baffle portions 123 may become damaged sooner than either of the side baffle portions 133, 143. The multi-core firearm suppressor 100 enable only the central main core 120 to be replaced if the side baffle portions 133, 143 are not damaged. Further, the multi-core design may enable the central main core 120 to be comprised of a different material than the side cores 130, 140. For example, the central main core 120 may be comprised of a stronger and/or tougher material than the side cores 130, 140. The design of the multi-core firearm suppressor 100 also may enable each component to be created by various formed of manufacturing such as, but not limited to, machining 3D printing, casing, metal injection molding, and plastic injection molding. The design of the multi-core firearm suppressor 100 may enable one component to be manufactured by a first process and a second component to be manufactured by a second different process.

Figure 39:
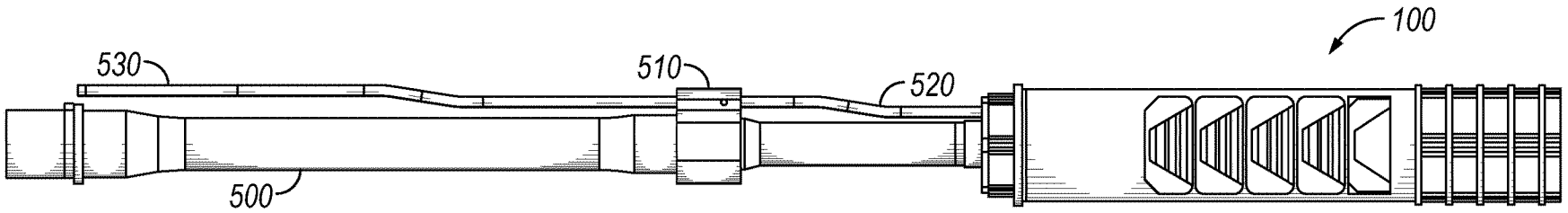
FIG. 39 shows the multi-core firearm suppressor of FIGS. 1-5 connected to a gas block of a firearm.
Figure 40:
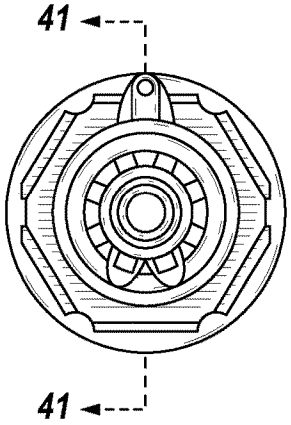
FIG. 40 is an end view of the multi-core firearm suppressor connected to the gas block of a firearm of FIG. 39.
Figure 41:
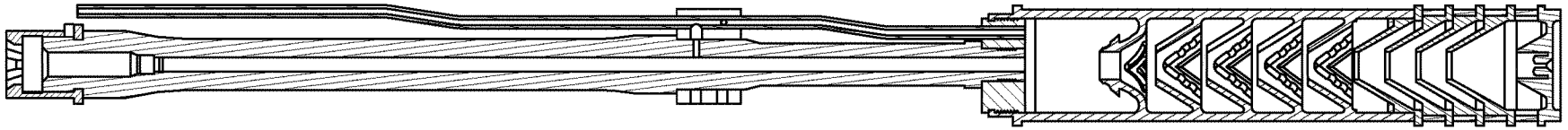
FIG. 41 is a cross-section view along line 41 of the multi-core suppressor connected to the gas block of a firearm of FIG. 40.

The central main core 120 includes a port 124 at the first end 121. As shown in FIGS. 39-41, the port 124 is configured to connect to a gas block 510 connected to a barrel 500 of a firearm (not shown). The port 124 is in fluid communication with the enclosed entrance chamber 101 of the multi-core firearm suppressor 100. A tube 520, or other means, may connect the port 124 of the central main core 120 and the gas block 510 of a connected firearm. The gas block 510 is connected to the passage 501 of the barrel via a port 502 in the barrel 500 and a port 511 in the gas block. The gas block 510 is connected to the receiver of the firearm via a tube 530, or other means, as would be appreciated by one of ordinary skill in the art having the benefit of this disclosure. Integration of the multi-core firearm suppressor 100 with the firearm system may extend dwell time by creating an interaction between the firearm's gas system and the enclosed entrance chamber 101 of the multi-core firearm suppressor 100. The gas system of the firearm may vent gas into the enclosed entrance chamber 101 of the multi-core firearm suppressor 100 so that the firearm doesn't start to unlock until the enclosed entrance chamber 101 is pressurized from the bullet passing though and gasses from the firearm being released in the multi-core firearm suppressor 100. This equalizes the pressure in the firearm's gas system and the vent, causing the firearm to cycle, which may keep the firearm cleaner and/or improve the sound suppressing function of the multi-core firearm suppressor 100 by keeping the action of the firearm in battery longer.

FIGS. 6-20 show an embodiment of a multi-core firearm suppressor 200. The suppressor includes a housing 110 having a first end 111 and a second end 112. A central main core 120 (best shown in FIGS. 10-13) is positioned within the housing 110. The central main core 120 includes a first end 121, a second end 122, and has a longitudinal centerline 125. The central main core 120 includes first internal threads 126 located at the first end 121 and second internal threads 127 located at the second end 122. The central main core 120 includes a plurality of central baffle portions 123 that are positioned adjacent to the longitudinal centerline 125. The central baffle portions 123 engage or interlock with baffle portions from a first side core 130 and a second side core 140 to form baffles within the housing 110 as discussed herein. The central baffle portions 123 include a projectile path 129 along the longitudinal centerline 125 to enable a projectile to pass through multi-core firearm suppressor 200. A plurality of modular baffles 210 are connected to the first end 121 of the central main core 120. An end cap 230 is connected to one of the modular baffles 210. An adapter 220 is connected to the second end 112 of the housing 110. The adapter 220 is configured to connect the multi-core firearm suppressor 200 to a firearm.

Figure 14:
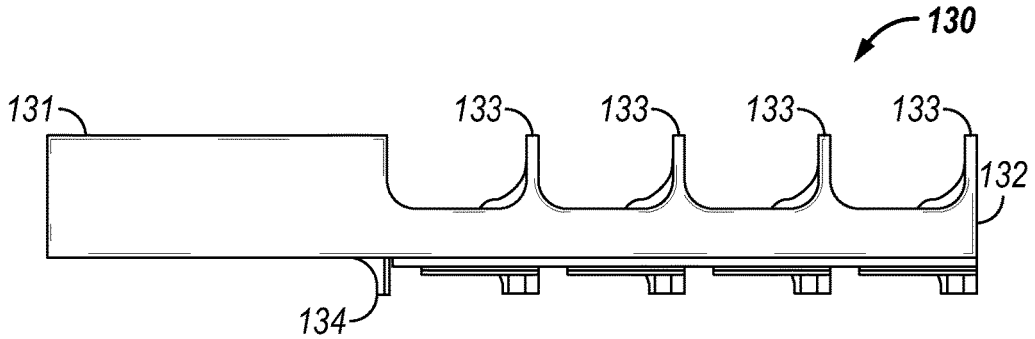
FIG. 14 shows a side view of a first side core that may be used in a multi-core firearm suppressor.

FIG. 14 shows an embodiment of a first side core 130. The multi-core firearm suppressor 200 includes a first side core 130 that is positioned within the housing 110 of the multi-core firearm suppressor 200. The first side core 130 includes a first end 131 and a second end 132. The first side core 130 is positioned between the housing 110 and a first side of the central main core 120. The first side core 130 includes a plurality of first side baffle portions 133. The first side core 130 also includes a portion 134 that engages the central main core 120 to help strengthen an enclosed entrance chamber 101 of the multi-core firearm suppressor 200.

Figure 15:
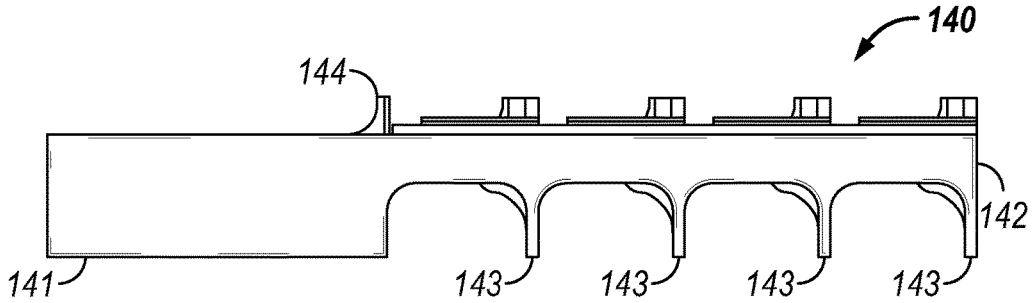
FIG. 15 shows a side view of a second side core that may be used in a multi-core firearm suppressor.

FIG. 15 shows an embodiment of a second side core 140. The multi-core firearm suppressor 200 includes a second side core 140 that is positioned within the housing 110. The second side core 140 includes a first end 141 and a second end 142. The second side core 140 is positioned between the housing 110 and a second side of the central main core 120. The second side core 140 includes a plurality of second side baffle portions 143. The second side core 140 also includes a portion 144 that engages the central main core 120 to help strengthen an enclosed entrance chamber 101 of the multi-core firearm suppressor 200.

When the central main core 120, first side core 130, and second side core 140 are positioned within the housing 110, the first side baffle portions 133 and the second side baffle portions 143 each engage the central baffle portions 123 to form baffles within the housing 110 that include a projectile path 129 along the longitudinal centerline 125. The combined baffles may be used to suppress the sound of the discharge of a firearm connected to the multi-core firearm suppressor 200 as would be appreciated by one of ordinary skill in the art having the benefit of this disclosure.

Figure 16:
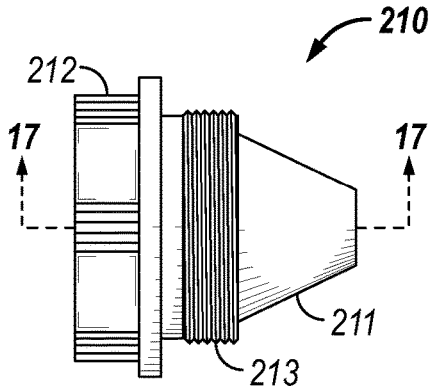
FIG. 16 shows an embodiment of a baffle that may be used in a multi-core firearm suppressor.
Figure 17:
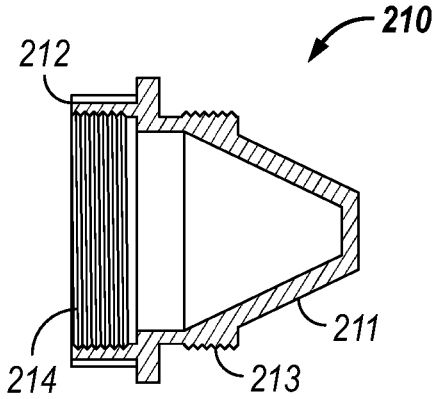
FIG. 17 shows a cross-section view of the baffle of FIG. 16 along line 17.

FIG. 16 shows an embodiment of a modular baffle 210 that may be within the housing 110. FIG. 17 shows a cross-section view of the modular baffle 210. One or more modular baffles 210 may be connected to the second end 121 of the central main core 120. The modular baffle 210 includes a first end 211 and a second end 212. The module baffle 210 include a passage along the centerline of the modular baffle 210 to permit the passage of a bullet as would be appreciated by one of ordinary skill in the art having the benefit of this disclosure. The modular baffle 210 includes external threads 213 and internal threads 214. The external threads 213 may be used to connect the modular baffle 210 to the second end 122 of the central main core 120 via the second threads 127. A second modular baffle 210 may then be connected to the first modular baffle via the external threads 213 on the second modular baffle 210 and the internal threads 214 on the first modular baffle 210. Multiple modular baffles 210 may be connected together and may be varied due to the application as would be appreciated by one of ordinary skill in the art having the benefit of this application.

Figure 18:
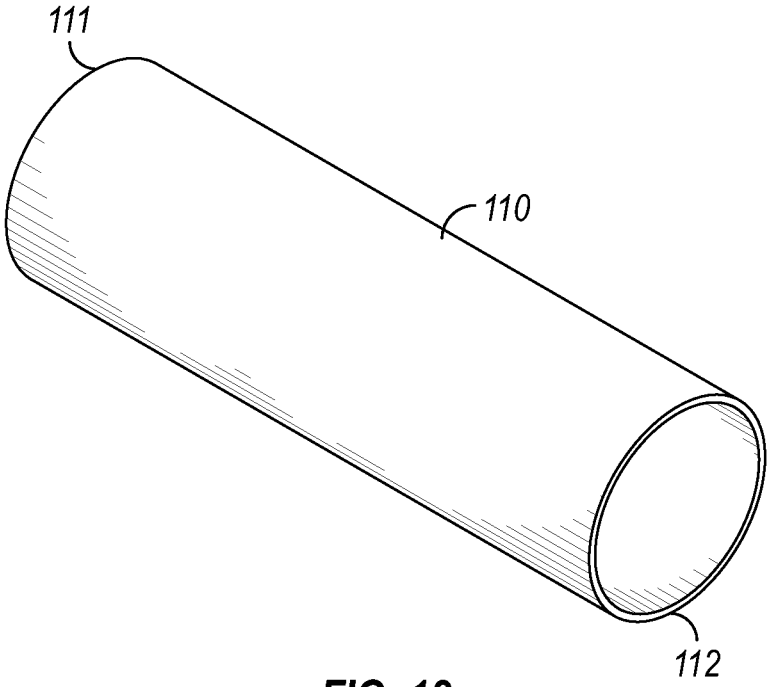
FIG. 18 shows a perspective view of a housing that may be used with a multi-core firearm suppressor.
Figure 19:
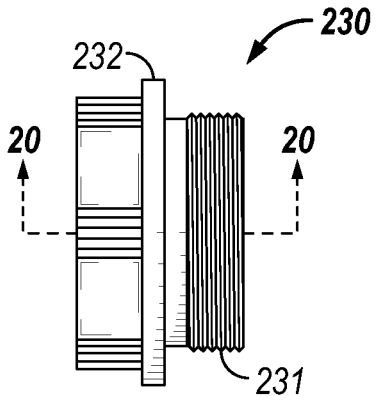
FIG. 19 shows a side view of an end cap that may be used with a multi-core firearm suppressor.
Figure 20:
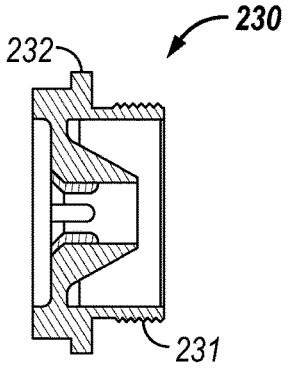
FIG. 20 shows a cross-section view along line 20 of the end cap of FIG. 19.
Figure 21:
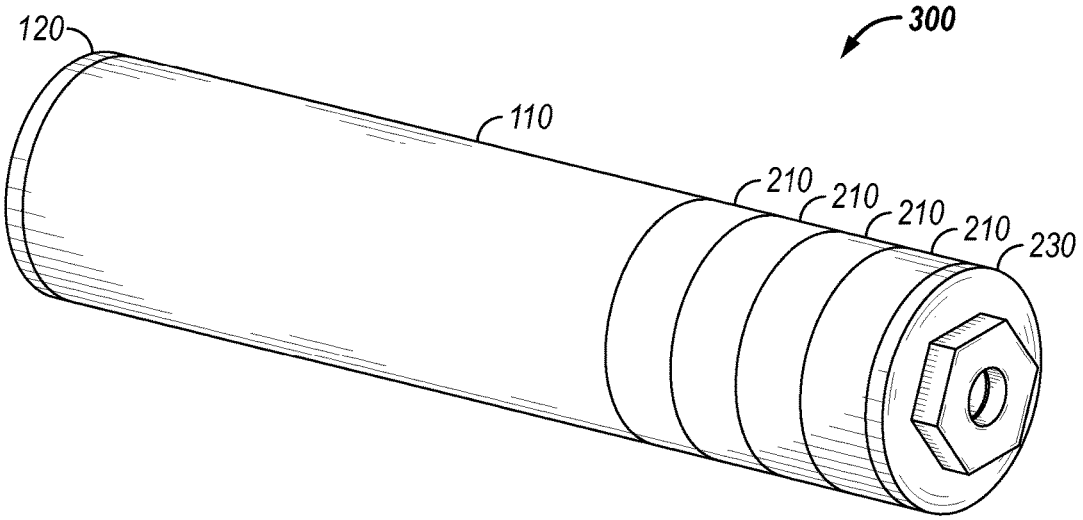
FIG. 21 shows a perspective view of an embodiment of a multi-core firearm suppressor.
Figure 22:
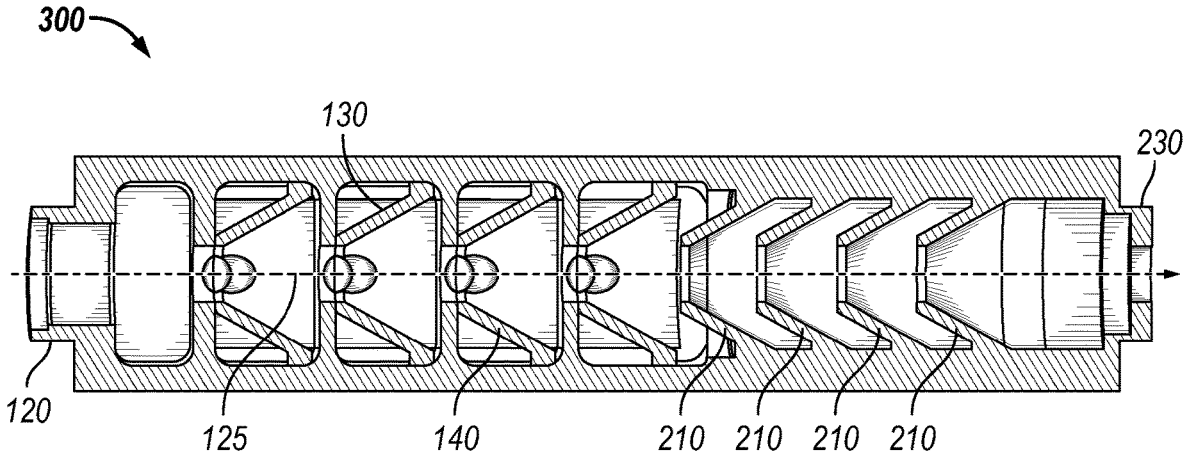
FIG. 22 shows a cross-section view of the multi-core firearm suppressor of FIG. 21.
Figure 23:
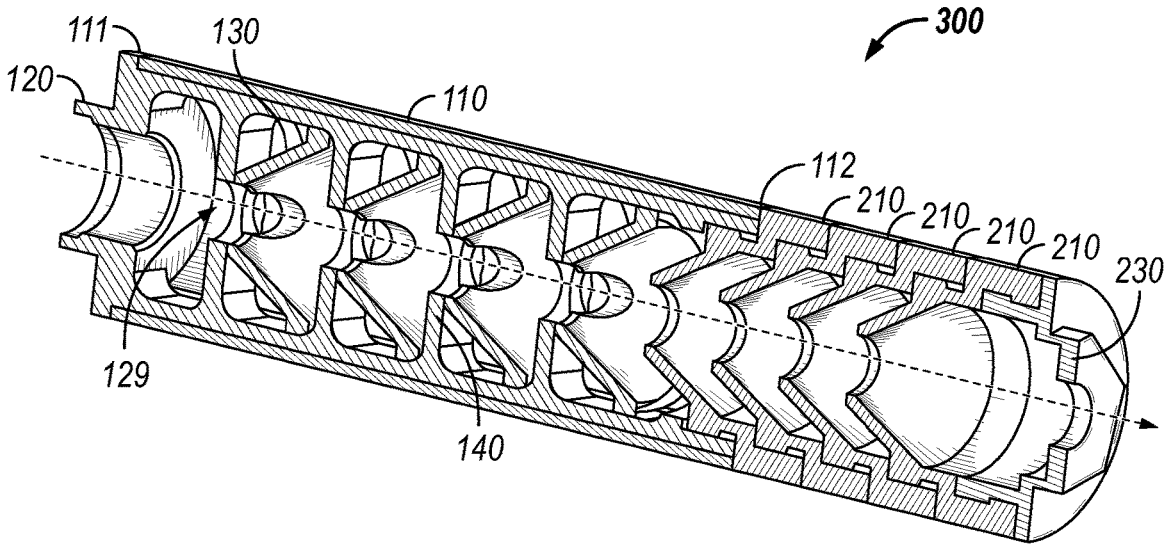
FIG. 23 shows a perspective cross-section view of the multi-core firearm suppressor of FIG. 21.
Figure 25:
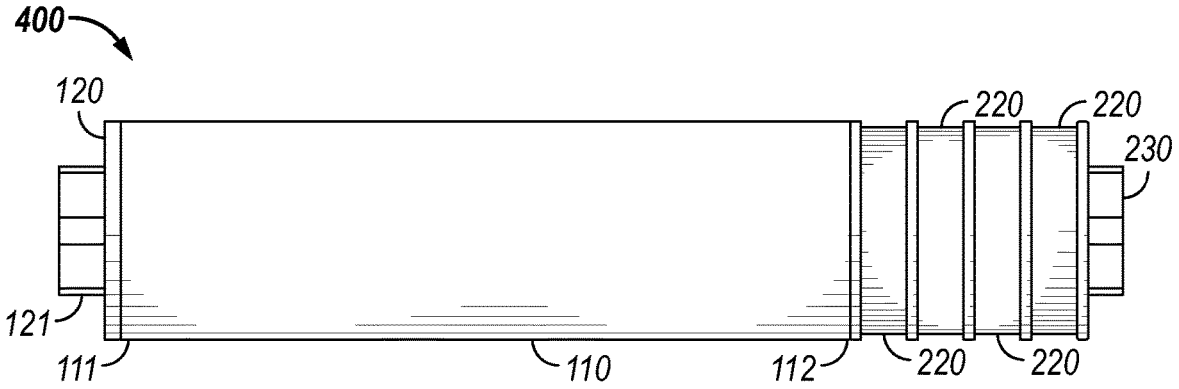
FIG. 25 shows an embodiment of a firearm suppressor having a multi-core.
Figure 24:
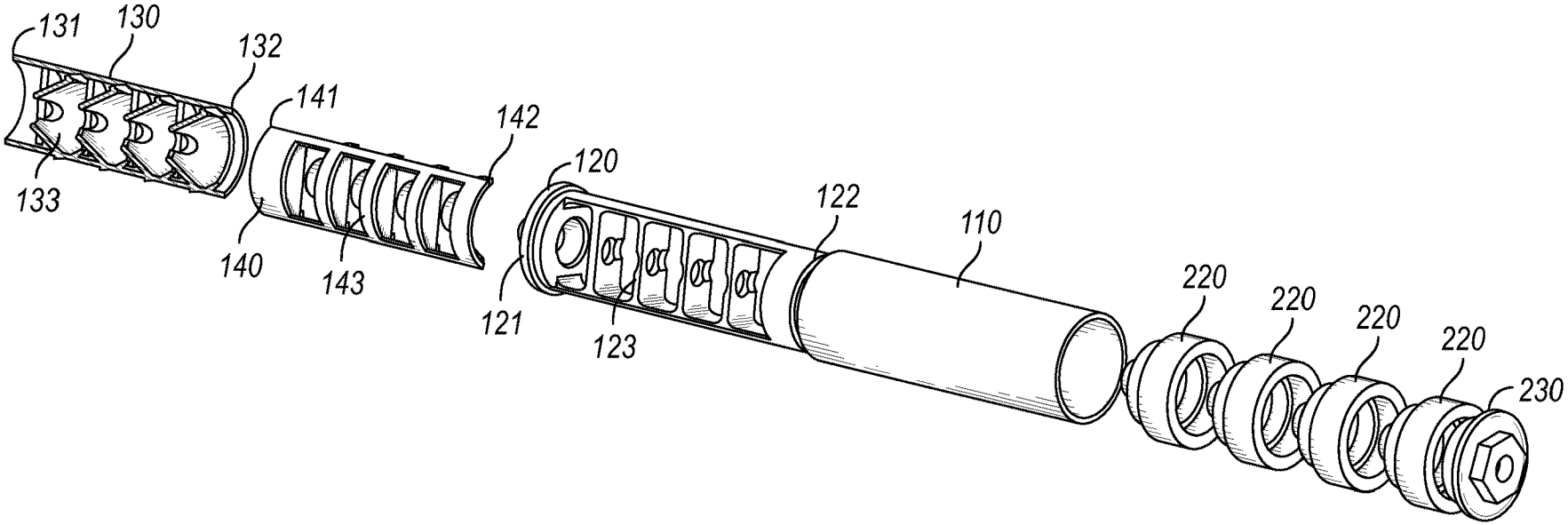
FIG. 24 shows an exploded view of the multi-core firearm suppressor of FIG. 21.
Figure 26:
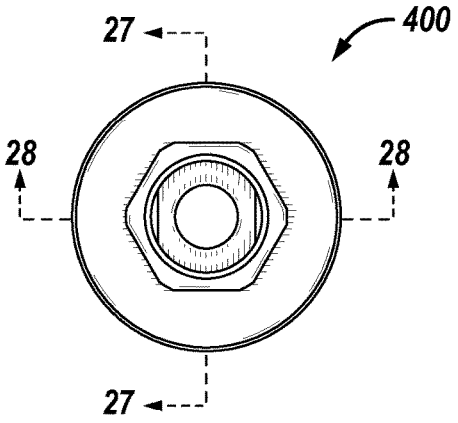
FIG. 26 shows an end view of the multi-core firearm suppressor of FIG. 25
Figure 27:
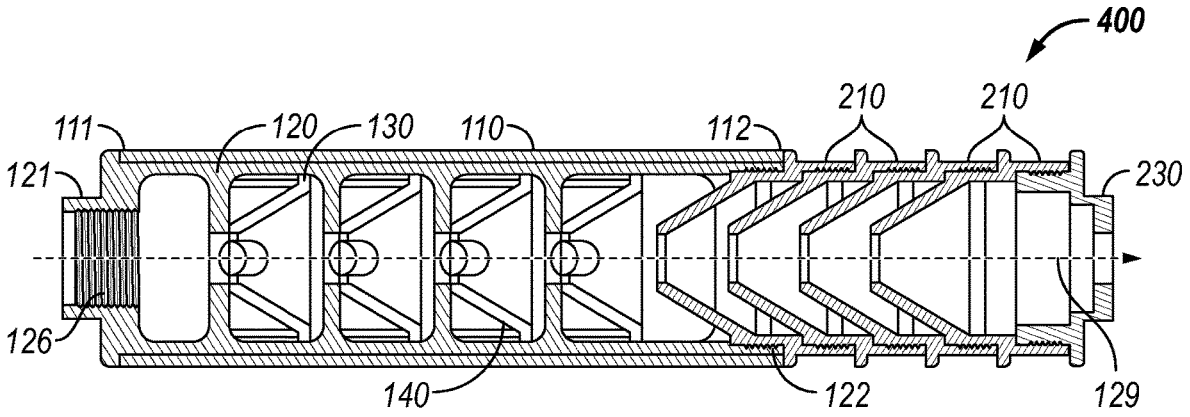
FIG. 27 shows a cross-section view along line 27 of the multi-core firearm suppressor of FIG. 25.
Figure 28:
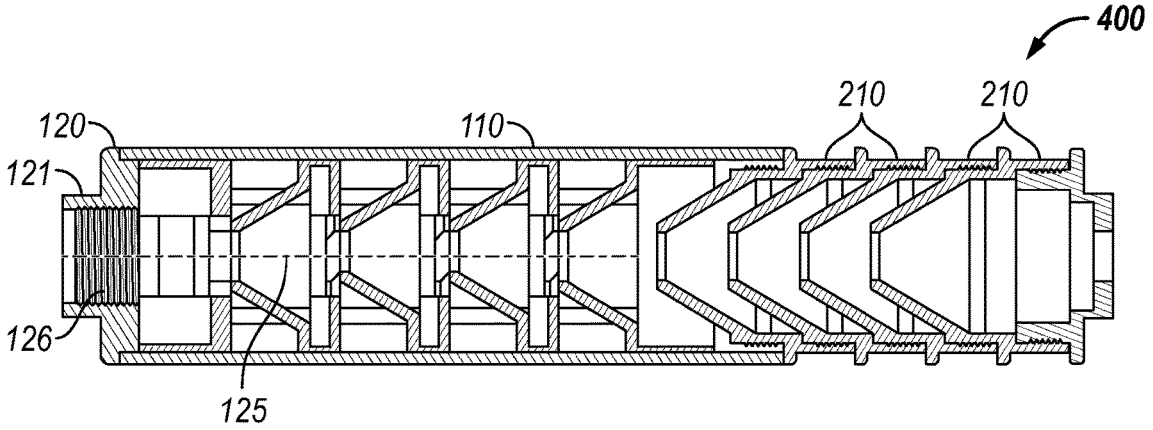
FIG. 28 shows a cross-section view along line 28 of the multi-core firearm suppressor of FIG. 25.
Figure 29:
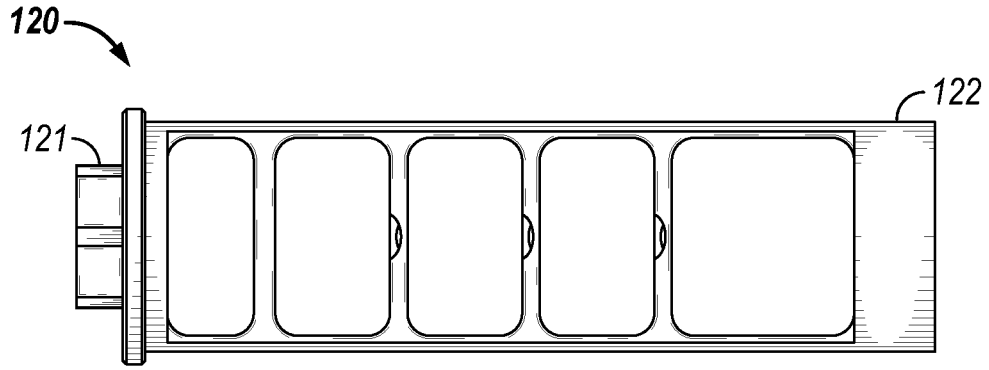
FIG. 29 shows an embodiment of a central main core that may be used in a multi-core firearm suppressor.
Figure 30:
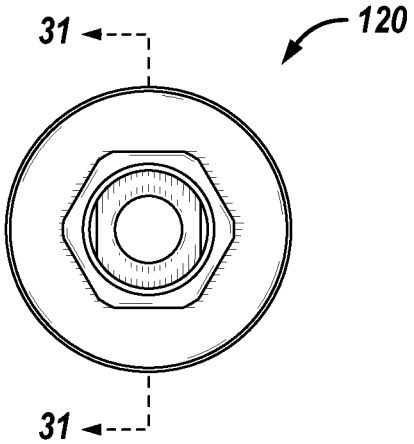
FIG. 30 shows an end view of the central main core of FIG. 29.
Figure 31:
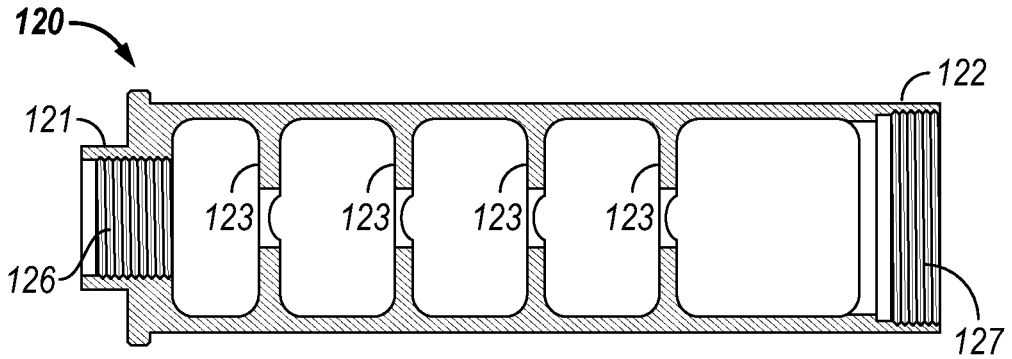
FIG. 31 shows a cross-section view along line 31 of the central main core of FIG. 29.

FIG. 18 shows an embodiment of a housing 110 having a first end 111 and a second end 112. The housing 110 may not include any internal or external threads. The components of the multi-core firearm suppressor 200 may be held within the housing 110 via connections between the various components. FIGS. 19 and 20 shows an embodiment of an end cap 230. The end cap 230 includes external threads 231 and a flange 232. The end cap 230 may be threaded onto a modular baffle 210. Alternatively, the end cap 230 could be threaded directly into the second end 122 of the central main core 120 via the second threads 127 in embodiments that do not include one or more modular baffles 210.

FIGS. 21-24 show an embodiment of a multi-core firearm suppressor 300 that includes one or more modular baffles 220. The multi-core firearm suppressor 300 includes a housing 110 having a first end 111 and a second end 112. A central main core 120 is positioned within the housing 110. The central main core 120 includes a first end 121, a second end 122, and has a longitudinal centerline 125. The first end 121 of the central main core 120 is configured to connect to the barrel of a firearm. The central main core 120 includes a plurality of central baffle portions 123 that are positioned adjacent to the longitudinal centerline 125. The central baffle portions 123 engage or interlock with baffle portions from a first side core 130 and a second side core 140 to form baffles within the housing 110 as discussed herein. The central baffle portions 123 include a projectile path 129 along the longitudinal centerline 125 to enable a projectile to pass through multi-core firearm suppressor 300.

The multi-core firearm suppressor 300 includes a first side core 130 that is positioned within the housing 110. The first side core 130 includes a first end 131 and a second end 132. The first side core 130 is positioned between the housing 110 and a first side of the central main core 120. The first side core 130 includes a plurality of first side baffle portions 133.

The multi-core firearm suppressor 300 includes a second side core 140 that is positioned within the housing 110. The second side core 140 includes a first end 141 and a second end 142. The second side core 140 is positioned between the housing 110 and a second side of the central main core 120. The second side core 140 includes a plurality of second side baffle portions 143.

When the central main core 120, first side core 130, and second side core 140 are positioned within the housing 110, the first side baffle portions 133 and the second side baffle portions 143 each engage the central baffle portions 123 to form baffles within the housing 110 that include a projectile path 129 along the longitudinal centerline 125. The combined baffles may be used to suppress the sound of the discharge of a firearm connected to the multi-core firearm suppressor 300. The combined baffles cause the expansion and contraction of the gas from the discharge of the firearm that reduces the sound of the discharge as would be appreciated by one of ordinary skill in the art having the benefit of this disclosure.

One or more modular baffles 220 are connected to the second end 122 of the central main core 120. The number of baffles 220 may be varied to change the length and/or performance of the multi-core firearm suppressor 300 as would be appreciated by one of ordinary skill in the art having the benefit of this disclosure. Various different shapes of modular baffles 220 may be used to change the performance of the multi-core firearm suppressor 300. An end cap 230 is connected to the end modular baffle 220.

FIGS. 25-38 show an embodiment of a multi-core firearm suppressor 400. The suppressor includes a housing 110 having a first end 111 and a second end 112. A central main core 120 (best shown in FIGS. 29-32) is positioned within the housing 110. The central main core 120 includes a first end 121, a second end 122, and has a longitudinal centerline 125. The central main core 120 includes first internal threads 126 located at the first end 121 and second internal threads 127 located at the second end 122. The central main core 120 includes a plurality of central baffle portions 123 that are positioned adjacent to the longitudinal centerline 125. The central baffle portions 123 engage or interlock with baffle portions from a first side core 130 and a second side core 140 to form baffles within the housing 110 as discussed herein. Likewise, the first side core 130 and the second side core 140 engage with each other as well as the central baffle portions 123 to form the baffles within the housing 110. The central baffle portions 123 include a projectile path 129 along the longitudinal centerline 125 to enable a projectile to pass through multi-core firearm suppressor 400. A plurality of modular baffles 210 are connected to the first end 121 of the central main core 120. An end cap 230 is connected to one of the modular baffles 210. The first end 121 of the central main core 120 is configured to connect the multi-core firearm suppressor 400 to a firearm via first internal threads 126.

Figure 32:
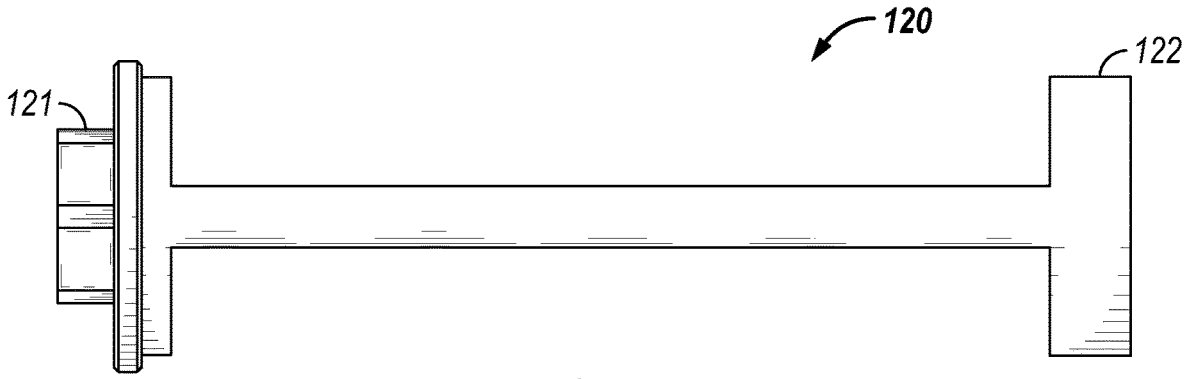
FIG. 32 shows a side view of the central main core of FIG. 29.

FIG. 32 shows an embodiment of a first side core 130. The multi-core firearm suppressor 400 includes a first side core 130 that is positioned within the housing 110 of the multi-core firearm suppressor 400. The first side core 130 includes a first end 131 and a second end 132. The first side core 130 is positioned between the housing 110 and a first side of the central main core 120. The first side core 130 includes a plurality of first side baffle portions 133.

Figure 33:
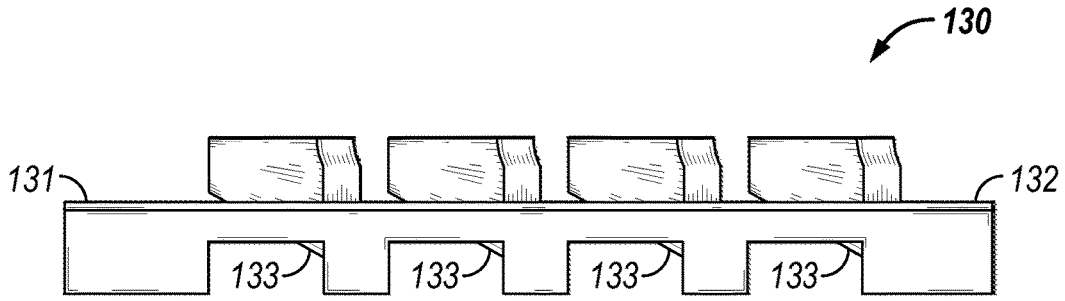
FIG. 33 shows a side view of a first side core that may be used in a multi-core firearm suppressor.
Figure 34:
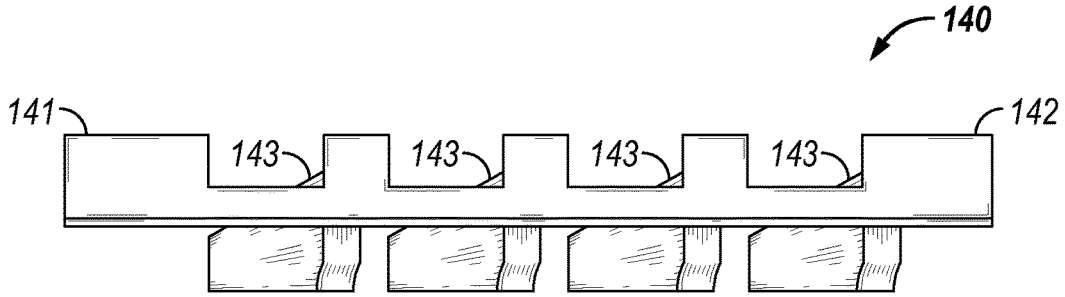
FIG. 34 shows a side view of a second side core that may be used in a multi-core firearm suppressor.

FIG. 33 shows an embodiment of a second side core 140. The multi-core firearm suppressor 400 includes a second side core 140 that is positioned within the housing 110. The second side core 140 includes a first end 141 and a second end 142. The second side core 140 is positioned between the housing 110 and a second side of the central main core 120. The second side core 140 includes a plurality of second side baffle portions 143.

When the central main core 120, first side core 130, and second side core 140 are positioned within the housing 110, the first side baffle portions 133 and the second side baffle portions 143 each engage the central baffle portions 123 to form baffles within the housing 110 that include a projectile path 129 along the longitudinal centerline 125. The combined baffles may be used to suppress the sound of the discharge of a firearm connected to the multi-core firearm suppressor 400 as would be appreciated by one of ordinary skill in the art having the benefit of this disclosure.

Figure 35:
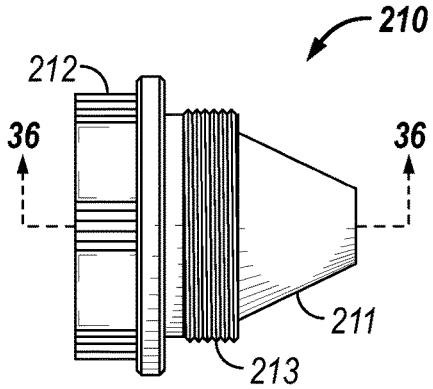
FIG. 35 shows an embodiment of a baffle that may be used in a multi-core firearm suppressor.
Figure 36:
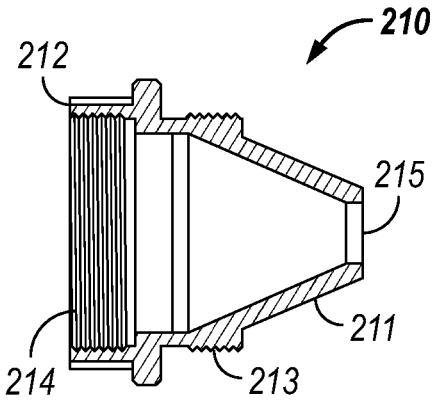
FIG. 36 shows a cross-section view along line 36 of the baffle of FIG. 35.

FIG. 35 shows an embodiment of a modular baffle 210 that may be within the housing 110. FIG. 36 shows a cross-section view of the modular baffle 210. One or more modular baffles 210 may be connected to the second end 121 of the central main core 120. The modular baffle 210 includes a first end 211 and a second end 212. The module baffle 210 include a passage 215 along the centerline of the modular baffle 210 to permit the passage of a bullet as would be appreciated by one of ordinary skill in the art having the benefit of this disclosure. The modular baffle 210 includes external threads 213 and internal threads 214. The external threads 213 may be used to connect the modular baffle 210 to the second end 122 of the central main core 120 via the second threads 127. A second modular baffle 210 may then be connected to the first modular baffle via the external threads 213 on the second modular baffle 210 and the internal threads 214 on the first modular baffle 210. Multiple modular baffles 210 may be connected together and may be varied due to the application as would be appreciated by one of ordinary skill in the art having the benefit of this application.

Figure 37:
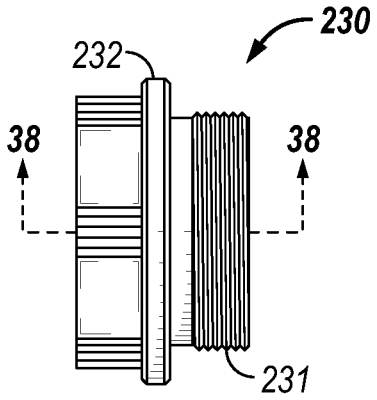
FIG. 37 shows an embodiment of an end cap that may be used in a multi-core firearm suppressor.
Figure 38:
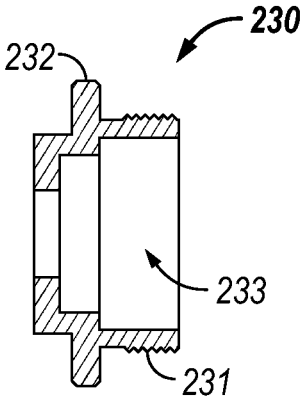
FIG. 38 shows a cross-section view along line 38 of the end cap of FIG. 37.

FIGS. 37 and 38 shows an embodiment of an end cap 230. The end cap 230 includes external threads 231 and a flange 232. The end cap 230 may be threaded onto a modular baffle 210. Alternatively, the end cap 230 could be threaded directly into the second end 122 of the central main core 120 via the second threads 127 in embodiments that do not include one or more modular baffles 210. The end cap 230 includes a central passage 233 that enables a bullet to pass through the end cap 230 as would be appreciated by one of ordinary skill in the art having the benefit of this disclosure.

Figure 42:
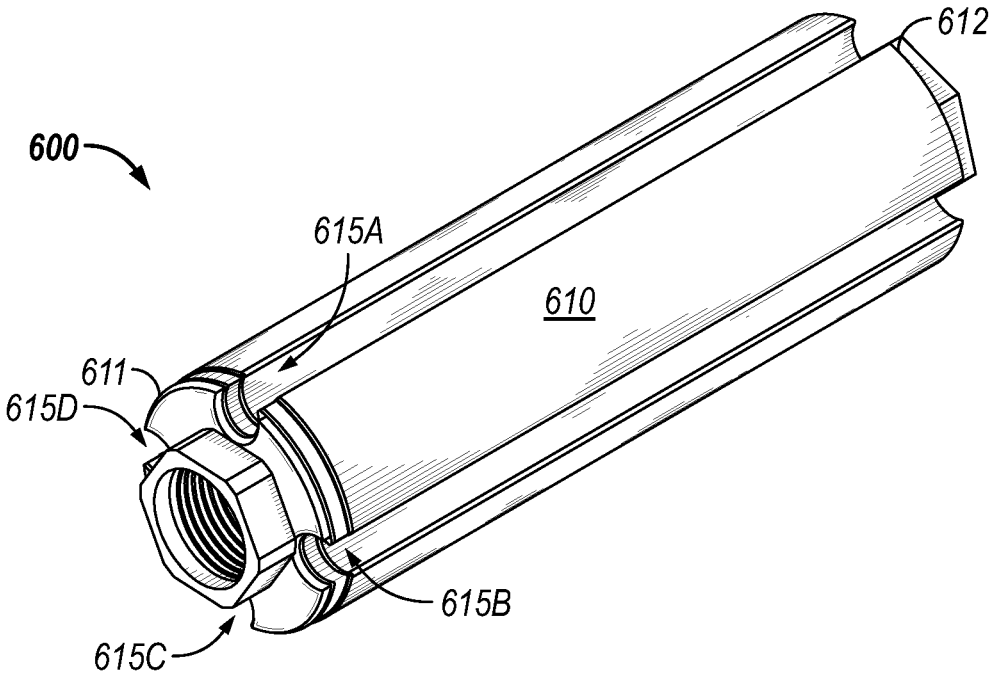
FIG. 42 is a perspective view of an embodiment of a firearm suppressor.
Figure 43:
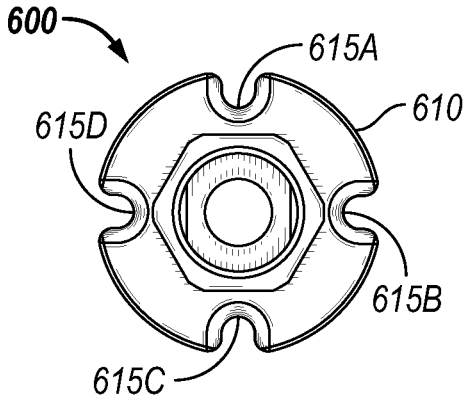
FIG. 43 is an end view of the firearm suppressor of FIG. 42.
Figure 44:
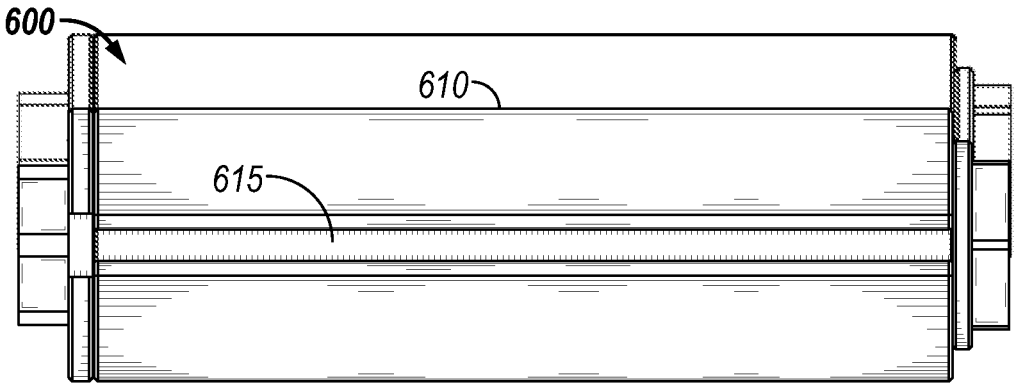
FIG. 44 is a side view of the firearm suppressor of FIG. 42.

FIGS. 42-44 shows an embodiment of a firearm suppressor 600. The firearm suppressor 600 includes a housing 610 having a plurality of grooves 615A, 615B, 615C, 615D that extend longitudinally along the exterior of the housing 610 from a first end 611 to a second end 612. The grooves, collectively as 615, may enable the use of sites located on the firearm. For example, a groove 615 on the firearm suppressor may be aligned with the top of the barrel of a firearm to enable the use of the sites when firing the firearm with the firearm suppressor 600 connected to the end of the barrel. The firearm suppressor 600 may be a multi-core firearm suppressor as discussed herein. The number, size, location, and/or configuration of the grooves 615 may be varied depending on the application as would be appreciated by one of ordinary skill in the art having the benefit of this disclosure. For example, the housing 610 of the firearm suppressor 600 may include more or less than four grooves located on the exterior of the housing 610.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A multi-core suppressor for a firearm, the multi-core suppressor comprising:

a housing having a first end and a second end;

a central main core positioned within the housing, the central main core having a first end, a second end, and a longitudinal centerline, the central main core having a plurality of central baffle portions positioned adjacent to the longitudinal centerline with a projectile path through the central baffle portions along the longitudinal centerline;

a first side core positioned within the housing, the first side core being positioned between the housing and a first side of the central main core, the first side core having a plurality of first side baffle portions, wherein a portion of the plurality of first side baffle portions extends toward the central main core;

a second side core positioned within the housing, the second side core being positioned between the housing and a second side of the central main core, the second side core having a plurality of second side baffle portions, wherein a portion of the plurality of second side baffle portions extends toward the central main core; and wherein the first side baffle portions engage the central baffle portions and the second side baffle portions engage the central baffle portions to form a plurality of baffles positioned within the housing.

2. The multi-core suppressor of claim 1, wherein the first side baffle portions engage the second side baffle portions to further form the plurality of baffles positioned within the housing.

3. The multi-core suppressor of claim 1, wherein the first side core and the second side core interlock with the central main core to form an enclosed entrance chamber.

4. The multi-core suppressor of claim 1, wherein the central main core includes first internal threads at the first end.

5. The multi-core suppressor of claim 4, wherein the internal threads are configured to connect the central main core to a barrel of a firearm.

6. The multi-core suppressor of claim 4, wherein the second end of the central main core includes second internal threads.

7. The multi-core suppressor of claim 6, comprising a modular baffle connected to the second end of the central main core via the second internal threads.

8. The multi-core suppressor of claim 6, comprising a plurality of modular baffles connected to the second end of the central main core.

9. The multi-core suppressor of claim 8, comprising an end cap connected to a modular baffle of the plurality of modular baffles.

10. The multi-core suppressor of claim 6, an end cap connected to the second end of the central main core.

11. The multi-core suppressor of claim 10, wherein the end cap is threaded into the second threads of the central main core.

12. The multi-core suppressor of claim 4, comprising an adapter connected to the first end of the central main core, the adapter configured to connect to a barrel of a firearm.

13. The multi-core suppressor of claim 1, wherein in the central main core includes a port at the first end configured to connect to a gas block of a firearm.

14. The multi-core suppressor of claim 1, further comprising one or more exterior grooves that extend from the first end to the second end.

15. The multi-core suppressor of claim 1, further comprising an enclosed entrance chamber.

16. The multi-core suppressor of claim 15, wherein the first side core further comprises a portion that extends toward the central main core, wherein the portion of the first side core that extends toward the central main core strengthens the enclosed entrance chamber.

17. The multi-core suppressor of claim 16, wherein the second side core further comprises a portion that extends toward the central main core, wherein the portion of the second side core that extends toward the central main core strengthens the enclosed entrance chamber.

18. A multi-core suppressor for a firearm, the multi-core suppressor comprising:

a housing having a first end and a second end;

a central main core positioned within the housing, the central main core having a first end, a second end, and a longitudinal centerline, the central main core having a plurality of central baffle portions positioned adjacent to the longitudinal centerline with a projectile path through the central baffle portions along the longitudinal centerline;

a first side core positioned within the housing, the first side core being positioned between the housing and a first side of the central main core, the first side core having a plurality of first side baffle portions, wherein a portion of the plurality of first side baffle portions extends toward the central main core;

a second side core positioned within the housing, the second side core being positioned between the housing and a second side of the central main core, the second side core having a plurality of second side baffle portions, wherein a portion of the plurality of second side baffle portions extends toward the central main core; and wherein the first side baffle portions engages the central baffle portions and the second side baffle portions and the second side baffle portions engage the central baffle portions and the first side baffle portions to form a plurality of baffles positioned within the housing.

* * * * *